United States Patent [19]

Hesse et al.

[11] 3,964,518

[45] June 22, 1976

[54] ELECTROHYDRAULIC CONTROL UNIT

[75] Inventors: Horst Hesse, Stuttgart; Walter Kobald, Schwieberdingen; Heinz Gand, Stuttgart; Rainer Hoheisel, Aldingen; Klaus Sopha, Stuttgart; Heinz Flaschar, Asperg; Heinz Kleinschmidt, Stuttgart; Winfried Arnold, Hochdorf; Werner Zeuch, Waiblingen, all of Germany

[73] Assignee: Robert Bosch G.m.b.H., Stuttgart, Germany

[22] Filed: Sept. 11, 1975

[21] Appl. No.: 612,577

[30] Foreign Application Priority Data

Oct. 2, 1974 Germany ..... 2446963

[52] U.S. Cl. ..... 137/625.64; 91/51

[51] Int. Cl.[2] ..... F15B 11/12; F15B 13/043

[58] Field of Search ..... 91/51; 137/625.6, 625.64

[56] References Cited

UNITED STATES PATENTS 2,944,526 7/1960 Jarvis ..... 91/51

3,582,039 6/1971 Cagle ..... 137/625.64 X

*Primary Examiner*—Alan Cohan

*Assistant Examiner*—Gerald A. Michalsky

*Attorney, Agent, or Firm*—Michael J. Striker

[57] ABSTRACT

An electrohydraulic control unit which regulates the flow of hydraulic fluid to and from one or more consumers by way of a directional control valve has a cylinder for a piston which is mechanically connected with or constitutes the spool of the directional control valve and divides the interior of the cylinder into two plenum chambers connected to the outlet of the pump, either directly or by way of a pressure reducing valve. The chambers are further connected with the tank and each of the fluid supplying and evacuating conduits for each of the two chambers contains a flow restrictor. Th flow restrictors in conduits for admission of fluid to the chambers are mounted upstream of check valves and the flow restrictors in conduits for evacuation of fluid from the chambers are mounted upstream of or constitute integral parts of two solenoid-operated auxiliary valves. The four flow restrictors together constitute a hydraulic bridge circuit.

10 Claims, 2 Drawing Figures

ELECTROHYDRAULIC CONTROL UNIT

BACKGROUND OF THE INVENTION

The present invention relates to control units which can regulate the flow of hydraulic fluid to and from one or more consumers, and more particularly to improvements in control units wherein the fluid flows to and from one or more consumers by way of one or more fluid flow regulating valves.

It is known to employ in control units for consumers of hydraulic fluid an adjusting apparatus wherein a piston has two end faces of identical cross-sectional area and is mounted between the chambers of a cylinder so that it can move axially and thereby changes the position of the valve member in a fluid flow regulating valve. It is also known to install flow restrictors in conduits which supply fluid to the chambers at the opposite ends of the piston and to control the outflow of fluid from such chambers by resorting to discrete auxiliary valves. The auxiliary valves are operated by solenoids. When the piston has moved the valve member to a selected position (e.g., to an intermediate position between a central or neutral position and one of two end positions), a continuous stream of pressurized fluid flows through one of the chambers, through the respective valve, and back to the tank. This causes substantial losses in pressurized fluid, especially if the valve member is to be held in an intermediate position for extended periods of time. Moreover, control units of the just outlined character require costly linear magnets which also consume energy as long as the valve member of the regulating valve remains in an intermediate position. Still further, the just described control unit employes one or more pressure modulating devices which reduce the pressure of fluid supplied to the adjusting apparatus and exhibit a pronounced tendency to vibrate or oscillate with attendant problems in connection with retention of the valve member in a predetermined position. Finally, the dynamic behavior of the just described conventional control units is far from satisfactory.

SUMMARY OF THE INVENTION

An object of the invention is to provide a control system which is simpler, more reliable and more accurate than heretofore known control systems.

Another object of the invention is to provide a control system whose energy requirements are lower than those of conventional control systems and wherein the adjusting apparatus requires minimal quantities of pressurized fluid to effect an adjustment in the position of associated flow regulating valve or valves.

A further object of the invention is to provide a control unit whose dynamic behavior is superior to that of conventional control units, which can be installed in existing hydraulic systems as a superior substitute for conventional control units, and wherein the means for changing the position of one or more valve members exhibits little or no tendency to oscillation.

Still another object of the invention is to provide a novel and improved adjusting apparatus for the fluid flow regulating valve of a control unit for admission of pressurized fluid to and for evacuation of spent fluid from one or more consumers of oil or another hydraulic fluid.

A further object of the invention is to provide a control unit wherein the adjusting apparatus for the valve member of a fluid flow regulating valve can be intimately combined with or incorporated into the flow regulating valve.

The invention is embodied in a control unit for selecting one of several positions for a controlled component and for thereupon maintaining the controlled component in the selected position as long as necessary, particularly in an electrohydraulic control unit or system which can be used with advantage to select any one of several positions for the spool in a multi-way directional control valve which regulates the flow of oil or another suitable hydraulic fluid between a pump and a reservoir on the one hand and one or more fluid-operated consumers on the other hand.

The control unit comprises a source of pressurized fluid (such source may comprise a pump and a supply conduit which receives pressurized fluid directly from the outlet of the pump or a pump and a control conduit which receives pressurized fluid from the outlet of the pump by way of a pressure reducing valve), a tank or another type of reservoir for hydraulic fluid, a cylinder, a piston which is reciprocable in and divides the interior of the cylinder into first and second chambers which are connected with the source by way of first conduits and with the reservoir by way of second conduits, first flow restrictors in the first conduits, check valves provided in the first conduits downstream of the respective first flow restrictors to prevent the fluid from flowing out of the respective chambers via first conduits, and means for regulating the outflow of fluid from the chambers to thereby change the axial position of the piston or to block the piston in a given axial position which corresponds to or constitutes the selected position of the controlled component. The piston includes first and second end faces having identical effective areas and being respectively adjacent to the first and second chambers. The aforementioned means for regulating the outflow of fluid from the chambers via second conduits comprises second flow restrictors in the second conduits and preferably solenoid-operated auxiliary valves having valve members which are movable between open and closed positions. The first and second flow restrictors constitute a hydraulic bridge circuit of the control unit.

The second flow restrictors may be mounted in the second conduits upstream of the respective auxiliary valves and each thereof preferably defines for the outflow of fluid a passage whose cross-sectional area is at most equal to but preferably less than the passage defined by the respective auxiliary valve in fully open position of the corresponding valve member.

Alternatively, the second flow restrictors may constitute integral parts of the respective auxiliary valves. In such control units, at least one first flow restrictor is preferably adjustable and the piston may constitute the reciprocable spool of a multi-way directional control valve; the first conduits are then preferably connected directly to the aforementioned supply conduit.

The novel features which are considered as characteristic of the invention are set forth in particular in the appended claims. The improved control unit itself, however, both as to its construction and its mode of operation, together with additional features and advantages thereof, will be best understood upon perusal of the following detailed description of certain specific embodiments with reference to the accompanying drawing.

DESCRIPTION OF THE PREFERRERD EMBODIMENTS

Figure 1:
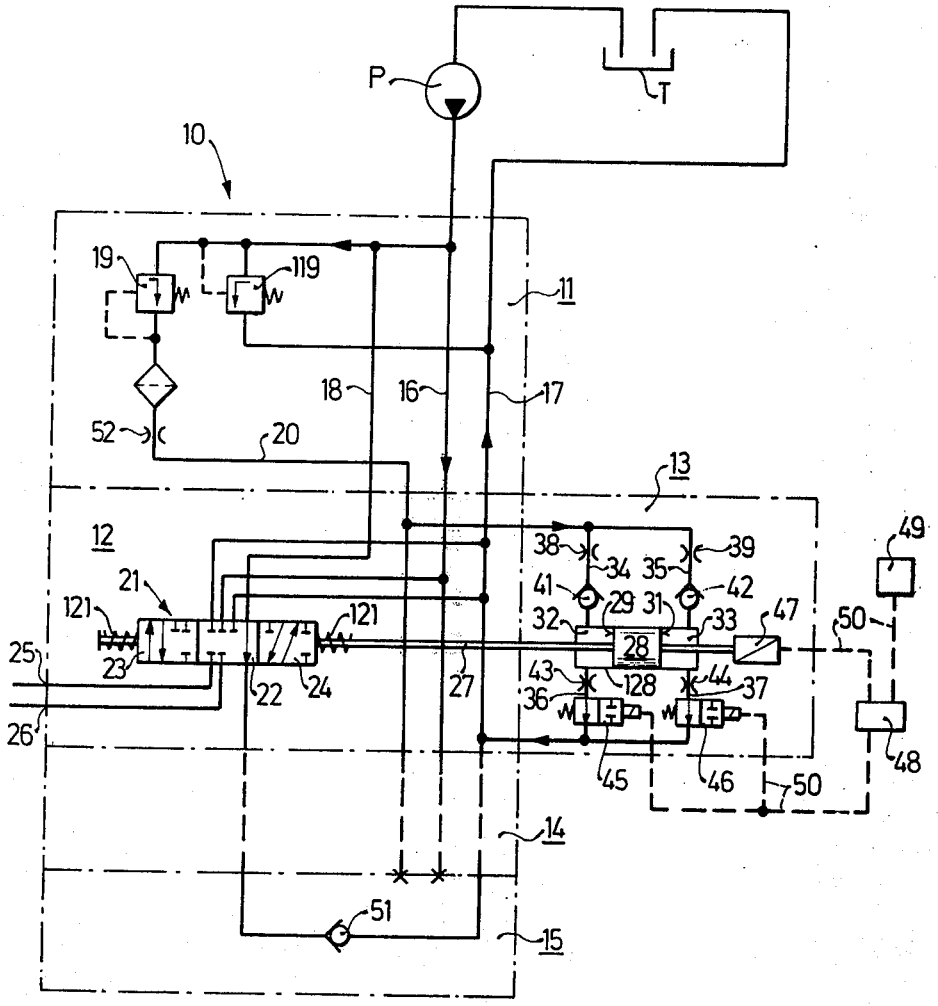
FIG. 1 is a diagrammatic view of a first control unit which includes an adjusting apparatus embodying one form of the invention.

FIG. 1 shows an electrohydraulic control unit 10 which comprises a housing having a first plate-like end section 11 and a second plate-like end section 15. The sections 11 and 15 flank the cylinders or bodies of two infinite-positioning multi-way directional control valves 12 and 14 of which only the valve 12 is shown in detail. The valve 12 is associated with an adjusting apparatus 13 which embodies one form of the invention. The source of pressurized hydraulic fluid includes a unidirectional fixed-displacement pump P which draws fluid from a reservoir or tank T and whose outlet admits pressurized fluid to a supply conduit 16. Spent fluid is conveyed into the tank T by way of a return conduit 17. A bypass conduit 18 connects the supply conduit 16 with the return conduit 17 by way of the valve 12 and contains a ball check valve 51 which is mounted in the end section 15. A control conduit 20 which branches from the conduits 16 and 18 contains a relief valve 119 having an outlet port connected with the return conduit 17, and a pressure reducing valve 19 located upstream of a flow restrictor 52.

The cylinder of the directional control valve 12 contains a reciprocable valve member or spool 21 which is movable between a median or neutral position 22, two end positions 23, 24, and an infinite number of intermediate positions at either side of the neutral position 22. The spool 21 controls the ports for conduits 16, 17, 18 and ports for pipes 25, 26 which latter connect the control unit 10 with a consumer (e.g., a double-acting hydraulic cylinder and piston assembly 9 of the type shown in FIG. 2).

The valve 14 can be associated with a second adjusting apparatus (not shown) to regulate the flow of hydraulic fluid (e.g., oil) to and from a second consumer.

The adjusting apparatus 13 can be installed in the body of the valve 12 and includes a rod-like member 27 serving to mechanically connect the spool 21 with a piston 28 which is reciprocable in a cylinder 128 between two plenum chambers 32, 33. The effective area of the left-hand end face 29 of the piston 28 is identical with the effective area of the right-hand end face 31. The chambers 32, 33 are connected with the control conduit 20 by conduits 34, 35 which respectively contain fixed flow restrictors 38, 39 and ball check valves 41, 42. The chambers 32, 33 are further connected with the return conduit 17 by conduits 36, 37 which respectively contain fixed flow restrictors 43, 44 and solenoid-operated auxiliary 2/2 valves 45, 46. The check valves 41, 42 are located downstream of the flow restrictors 38, 39, as considered in the direction of fluid flow into the chambers 32, 33, and the valves 45, 46 are located downstream of the flow restrictors 43, 44, as considered in the direction of fluid flow from the chambers 32, 33. The flow restrictors 38, 39, 43, 44 constitute a hydraulic bridge circuit and are properly adjusted with respect to each other. The check valves 41, 42 prevent return flow of fluid from the respective chambers 32, 33, via conduits 34, 35.

The axial position of the connecting member 27 (and hence the position of the piston 28) is monitored by an inductive detector circuit 47 which is electrically connected with a conventional electronic control circuit 48. The latter is further connected with a preferably adjustable rated value selector 49 (e.g., a suitable potentiometer) which furnishes signals indicating the desired position of the piston 28 and hence the desired position of the spool 21. The output of the control circuit 48 is connected with the solenoids of the auxiliary valves 45, 46. The reference characters 50 denote conductors between the control circuit 48 on the one hand and the valves 45, 46, rated value selector 49 and detector circuit 47 on the other hand. When the solenoids of the valves 45, 46 are deenergized, the valve members of the respective auxiliary valves are held in open positions. When the valve member of the valve 45 or 46 is held in open position, it provides a passage whose cross-sectional area is greater than that defined by the respective flow restrictor 43, 44, i.e., the auxiliary valves 45, 46 cannot throttle the flow of fluid downstream of the flow restrictors 43, 44 as long as their solenoids are deenergized.

The purpose of the check valve 51 in the end plate 15 is to maintain the fluid in the conduit 20 under a certain pressure. Such pressure (which prevails between the pressure reducing valve 19 and the check valve 51) is needed for proper operation of the adjusting apparatus 13. The flow restrictor 52 in the control conduit 20 immediately downstream of the pressure reducing valve 19 prevents an excessive drop of fluid pressure when the auxiliary valves 45, 46 are open; this is especially important if the control unit comprises two or more directional control valves irrespective of whether or not the additional directional control valve or valves (such as the valve 14) are associated with discrete control apparatus.

The operation:

The pump P is assumed to be driven by a suitable prime mover so that the conduits 16, 18, 20 receive pressurized hydraulic fluid. The adjusting apparatus 13 maintains the valve members of the auxiliary valves 45, 46 in closed positions. The fluid pressure which builds up in the control conduit 20 is communicated to the fluid in chambers 32, 33 via conduits 34, 35 and flow restrictors 38, 39. The conduits 36, 37 are sealed because the solenoids of the auxiliary valves 45, 46 are energized. Consequently, fluid which fills the chambers 32, 33 blocks or arrests the piston 28 in the illustrated position whereby the connecting rod 27 maintains the spool 21 in in a corresponding axial position. The auxiliary valves 45, 46 are preferably of the type which can react within a few milliseconds so that they can effectively control the outflow of minute quantities of hydraulic fluid.

If the detector circuit 47 transmits to the control circuit 48 a signal whose intensity or another characteristic is different from the characteristic of signal furnished by the rated value selector 49, the control circuit 48 opens the auxiliary valve 45 or 46 so that the pressure drop caused by the flow restrictors 38, 43 differs from that produced by the flow restrictors 39, 44. Consequently, the pressure of fluid in the chamber 32 deviates from fluid pressure in the chamber 33 and the piston 28 moves axially to change the position of the spool 21 through the medium of the connecting rod 27. The piston 28 moves in a direction toward that conduit (36 or 37) wherein the auxiliary valve (45 or 46) is open. When the piston 28 reaches the position which is indicated by the signal from the selector 49 to the control circuit 48, the latter immediately returns the valve member of the previously open auxiliary valve 45 or 46 to closed position so that the fluid which is entrapped in the chambers 32, 33 locks the piston 28 in the desired axial position. This insures that forces developing as a result of fluid flow through the directional control valve 12 cannot change the axial position of the spool 21.

If the control circuit 48 causes the auxiliary valves 45, 46 to open simultaneously, the spring-centered spool 21 automatically reassumes or remains in its neutral position. The springs which center the spool 21 are shown at 121.

The piston 28 can move the spool 21 to an infinite number of positions including the positions 22, 23, 24 and any selected position between the positions 22, 23 or 22, 24. This is achieved by resorting to a surprisingly small number of commercially available parts including flow restrictors, check valves, solenoid operated valves for regulation of minute fluid flows and the like. As stated above, when the auxiliary valve 45 or 46 is open, it allows the fluid to flow therethrough at a rate which exceeds the rate of fluid flow through the respective flow restrictor 43, 44. Consequently, the valves 45, 46 cannot influence that relationship of fluid pressure which is determined by the hydraulic bridge circuit including the flow restrictors 38, 39, 43 and 44. In other words, it is only necessary to properly select the throttling action of the four flow restrictors without considering the auxiliary valves 45, 46.

An important advantage of the adjusting apparatus 13 is that it can invariably block the spool 21 in a selected axial position and also that its consumption of pressurized fluid is negligible. This is particularly important when the pump P must supply pressurized fluid to several consumers, i.e., when the control unit 10 contains two or more directional control valves. Another important advantage of the adjusting apparatus 13 is that it effectively prevents oscillations or vibrations of the piston 28 beyond the selected axial position, i.e., the spool 21 can be held in a selected position with a high degree of accuracy and reproducibility.

Figure 2:
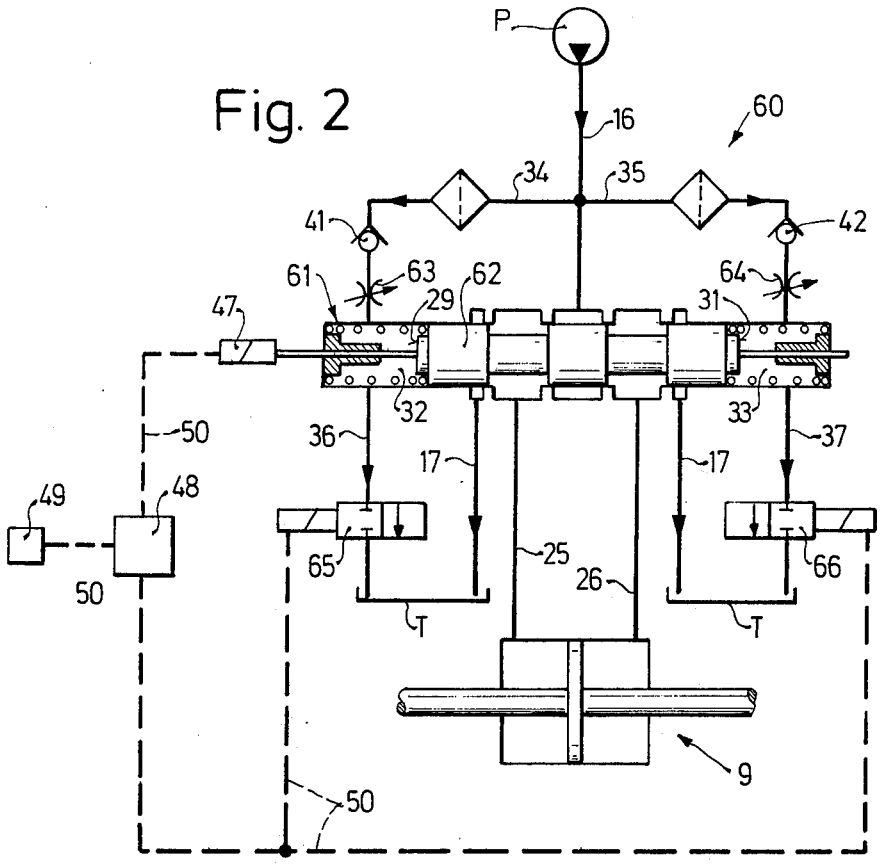
FIG. 2 is a fragmentary diagrammatic view of a second control unit which embodies a modified adjusting apparatus.

FIG. 2 shows a second control unit 60 with an adjusting apparatus which constitutes a simplified version of the adjusting apparatus 13. In this embodiment of the invention, the spool 62 in the cylinder 61 of the directional control valve performs the functions of the spool 21, connecting rod 27 and piston 28. The flow restrictors 63, 64 (which respectively correspond to the flow restrictors 38, 39 of FIG. 1) in conduits 34, 35 are adjustable, and the flow restrictors 43, 44 of FIG. 1 are omitted because the auxiliary valves 65, 66 are designed in such a way that they perform the functions of valves 45, 46 and act as flow restrictors for fluid in the conduits 36, 37. It can be said that the flow restrictors 43, 44 of FIG. 1 are built into the auxiliary valves 65, 66. All such parts of the structure shown in FIG. 2 which are clearly analogous to or identical with the corresponding parts of the structure of FIG. 1*a* are denoted by similar reference characters.

The check valves 41, 42 are mounted upstream of the respective adjustable flow restrictors 63, 64.

The operation of the control unit 60 is very similar to that of the control unit 10. One of the differences is that the pressure of fluid in plenum chambers 32, 33 at the opposite ends of the piston 62 equals the fluid pressure in the supply conduit 16 because the latter supplies fluid directly to the conduits 34, 35. Also, the auxiliary valves 65, 66 form part of the hydraulic bridge circuit because they embody or replace the flow restrictors 43, 44 of FIG. 1. The flow restrictors 63, 64 of FIG. 2 are adjustable (or at least one thereof is adjustable) in order to facilitate proper adjustment or tuning of the bridge circuit 63–66. The valves 65, 66 are preferably designed with a view to insure that they can control the relatively high working pressures of fluid. The manner in which pressurized fluid can flow into and spent fluid can flow from the right-hand or left-hand chamber of the double-acting cylinder of the consumer 9 in response to axial displacements of the piston 62 is self-evident.

The control units 10 and 60 exhibit a number of important advantages. First of all, their construction is very simple and they occupy little room. Also, they can utilize simple, compact and inexpensive commercially available valves which must control the flow of relatively small quantities of fluid. Still further, the auxiliary valves prevent any flow of fluid through the chamber 32 and/or 33 when the piston 28 or 62 assumes a selected position, i.e., fluid will flow through the adjusting apparatus only when it is necessary to change the position of the piston. This greatly reduces the energy requirements of the control unit. The piston 28 or 62 exhibits little or no tendency to oscillate, and its dynamic behavior is highly satisfactory. The illustrated adjusting apparatus and their equivalents are especially suited to select any one of several positions for a reciprocable spool and to thereupon maintain the spool in a selected position as long as desired.

The improved control units are susceptible of many additional modifications without departing from the spirit of the invention. The adjusting apparatus in particular can be modified in a number of ways. For example, the electrical means for initiating changes in the axial position of piston 28 or 62 may be replaced by other types of position changing means. Also, the valve 12 or 61 can regulate the flow of fluid to and from two or more consumers. Each of the two bridge circuits may consist exclusively of adjustable flow restrictors, and the illustrated directional control valves can be replaced by one or more valves wherein the valve member (e.g., a spool) is movable between a finite number of different positions.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. In a control unit for selecting one of several positions for a controlled component, particularly in an electrohydraulic control unit for selecting any one of several positions for the spool in a multi-way directional control valve, a combination comprising a source of pressurized fluid; a reservoir; a cylinder; a piston reciprocable in and dividing the interior of said cylinder into first and second chambers, said piston including first and second end faces having identical areas and being respectively adjacent to said first and second chambers; first conduits connecting said chambers with said source; second conduits connecting said chambers with said reservoir; first flow restrictors in said first conduits; check valves provided in said first conduits to prevent the fluid from flowing out of the respective chambers via said first conduits; and means for regulating the outflow of fluid from said chambers via said second conduits, including second flow restrictors in said second conduits and auxiliary valves provided in said second conduits, each of said auxiliary valves having a valve member movable between open and closed positions and said first and second flow restrictors together constituting a hydraulic bridge circuit.

2. A combination as defined in claim 1, wherein each of said second flow restrictors defines for the fluid a passage whose cross-sectional area is less than that defined by the corresponding auxiliary valve in the open position of the respective valve member.

3. A combination as defined in claim 2, wherein said auxiliary valves are located downstream of the respective second flow restrictors, as considered in the direction of fluid flow through said second conduits.

4. A combination as defined in claim 1, wherein said controlled component is a reciprocable spool forming part of a multi-way directional control valve, and further comprising means for mechanically connecting said piston with said reciprocable spool so that the position of the spool changes in response to fluid-induced axial displacement of said piston in said cylinder.

5. A combination as defined in claim 1, wherein at least one of said flow restrictors is adjustable.

6. A combination as defined in claim 5, wherein each of said first flow restrictors is adjustable and each of said second flow restrictors forms part of the respective auxiliary valve.

7. A combination as defined in claim 1, wherein said piston constitutes the reciprocable spool of a multi-way directional control valve.

8. A combination as defined in claim 7, wherein said source comprises a pump and a supply conduit which is in direct communication with said first conduits.

9. A combination as defined in claim 1, further comprising means for monitoring the position of said piston in said cylinder, and means for opening one of said auxiliary valves when the position of said piston deviates from a preselected position.

10. A combination as defined in claim 1, wherein at least one of said auxiliary valves is a solenoid-operated valve which is open when the respective solenoid is deenergized.

* * * * *